US006573867B1

(12) United States Patent
Desclos et al.

(10) Patent No.: US 6,573,867 B1
(45) Date of Patent: Jun. 3, 2003

(54) SMALL EMBEDDED MULTI FREQUENCY ANTENNA FOR PORTABLE WIRELESS COMMUNICATIONS

(75) Inventors: Laurent Desclos, San Diego, CA (US); Gregory Poilasne, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 10/077,404

(22) Filed: Feb. 15, 2002

(51) Int. Cl.[7] ..... H01Q 1/38; H01Q 1/24
(52) U.S. Cl. ..... 343/700 MS; 343/702
(58) Field of Search ..... 343/700 MS, 702, 343/846, 767, 770

(56) References Cited

U.S. PATENT DOCUMENTS

| | | | | |
|---|---|---|---|---|
| 3,721,990 | A | 3/1973 | Gibson et al. | 343/726 |
| 4,450,449 | A | 5/1984 | Jewitt | 343/700 MS |
| 4,684,952 | A | 8/1987 | Munson et al. | 343/700 MS |
| 4,749,996 | A | 6/1988 | Tresselt | 343/700 MS |
| 5,245,745 | A | 9/1993 | Jensen et al. | 343/700 MS |
| 5,309,164 | A | 5/1994 | Dienes et al. | 343/700 MS |
| 5,410,323 | A | 4/1995 | Kuroda | 343/700 MS |
| 5,450,090 | A | 9/1995 | Gels et al. | 343/700 MS |
| 5,627,550 | A | 5/1997 | Sanad | 343/700 MS |
| 5,781,158 | A | 7/1998 | Ko et al. | 343/700 MS |
| 5,835,063 | A | 11/1998 | Brachat et al. | 343/700 MS |
| 5,943,020 | A | 8/1999 | Liebendoerfer et al. | 343/702 |
| 5,966,096 | A | 10/1999 | Brachat | 343/700 MS |
| 5,986,606 | A | 11/1999 | Kossiavas et al. | 343/700 MS |
| 6,002,367 | A | 12/1999 | Engblom et al. | 343/700 MS |
| 6,008,762 | A | 12/1999 | Nghiem | 343/700 MS |
| 6,114,996 | A | 9/2000 | Nghiem | 343/700 MS |
| 6,133,880 | A | 10/2000 | Grangeat et al. | 343/700 MS |
| 6,140,965 | A | 10/2000 | Van Hoozen | 343/700 MS |
| 6,140,969 | A | 10/2000 | Lindenmeier et al. | 343/700 MS |
| 6,147,649 | A | 11/2000 | Ivrissimtzis et al. | 343/700 MS |
| 6,157,348 | A | 12/2000 | Openlander | 343/846 |
| 6,181,281 | B1 | 1/2001 | Desclos et al. | 343/700 MS |
| 6,195,051 | B1 | 2/2001 | McCoy et al. | 343/700 MS |
| 6,211,825 | B1 | 4/2001 | Deng | 343/700 MS |
| 6,323,810 | B1 | 11/2001 | Poilasne | 343/700 MS |
| 6,456,243 | B1 * | 9/2002 | Poilasne et al. | 343/700 MS |

* cited by examiner

*Primary Examiner*—Hoang Nguyen
(74) *Attorney, Agent, or Firm*—Blakely, Sokoloff, Taylor & Zafman LLP

(57) ABSTRACT

A compact broadband or multi-band antenna structure comprises a first conductor lying in a reference plane; a second conductor extending longitudinally parallel to the reference plane having a first end electrically connected to the first conductor and a second end, the second conductor having a plurality of laterally extending fingers; a third conductor extending longitudinally parallel to the reference plane having a first end electrically connected to the first conductor and a second end overlapping, but spaced apart, from the second end of the second conductor; and an antenna feed coupled to one of the second and third conductors.

21 Claims, 6 Drawing Sheets

SMALL EMBEDDED MULTI FREQUENCY ANTENNA FOR PORTABLE WIRELESS COMMUNICATIONS

REFERENCES TO RELATED APPLICATIONS

This application also relates to U.S. Pat. No. 6,323,810, entitled "Multimode Grounded Finger Patch Antenna" by Gregory Poilasne et al., which is owned by the assignee of this application and incorporated herein by reference.

This application is also related to co-pending application Ser. No. 09/892,928 entitled "Multi Frequency Magnetic Dipole Antenna Structures and Methods of Reusing the Volume of an Antenna" by Laurent Desclos et al., owned by the assignee of this application and incorporated herein by reference.

BACKGROUND OF THE INVENTION

1. Field of the Invention

This invention relates to antennas for use with radio frequency transceivers. More particularly, the invention provides a small broadband or multi-band antenna for wireless communications, such as cellular telephones and the like.

2. Background

Cellular telephones and other wireless communications devices are widely used. Such devices have steadily grown smaller with advances in the miniaturization of electronic components. This creates ever-increasing challenges for the design of antennas used in such devices since it is generally desirable to avoid using an external antenna. As wireless communications devices have become more sophisticated, there is a need to provide an antenna with broadband or multi-band capabilities, thereby adding further challenges to the design of the antenna. For example, cellular telephones with GSM, DCS and PCS capability require an antenna capable of transmitting and receiving at 900 MHz, 1800 MHz and 1900 MHz.

Our co-pending application Ser. No. 09/892,928 discloses various designs for a multi-resonant antenna structure in which the various resonant modes share at least portions of the antenna structure volume.

SUMMARY OF THE INVENTION

The present invention provides a compact broadband or multi-band antenna. Various embodiments are disclosed. The basic antenna structure comprises a first conductor lying in a reference plane; a second conductor extending longitudinally parallel to the reference plane having a first end electrically connected to the first conductor and a second end, the second conductor having a plurality of laterally extending fingers; a third conductor extending longitudinally parallel to the reference plane having a first end electrically connected to the first conductor and a second end overlapping, but spaced apart, from the second end of the second conductor; and an antenna feed coupled to one of the second and third conductors.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Antennas for portable wireless devices must be designed to be very compact. At the same time, it is desirable for the antennas to have a large bandwidth and/or to have multi-band capability. Thus, one of the objectives of antenna design for portable wireless devices is to reduce the volume-to-bandwidth ratio. This design objective can also be expressed with the "K law", which may be expressed as follows:

$$\Delta f/f = K \cdot V/\lambda^3$$

where:

$\Delta f/f$ is the normalized frequency bandwidth, $\lambda$ is the wavelength, and V is the volume enclosing the antenna.

As disclosed in prior application Ser. No. 09/892,928, one solution for improving the K factor is to reuse the volume of the antenna with different orthogonal modes. While the modes do not use exactly the same volume, they share a common portion of the available volume. Some antenna designs, such as disclosed in U.S. Pat. No. 6,323,810, inherently benefit from the effect, even though the design of the antenna has not been optimized to exploit this effect.

At lower frequencies, such as in the 800–900 megahertz range, the volume reuse solution disclosed in application Ser. No. 09/892,928 is not as effective in providing a large bandwidth.

Figure 1:
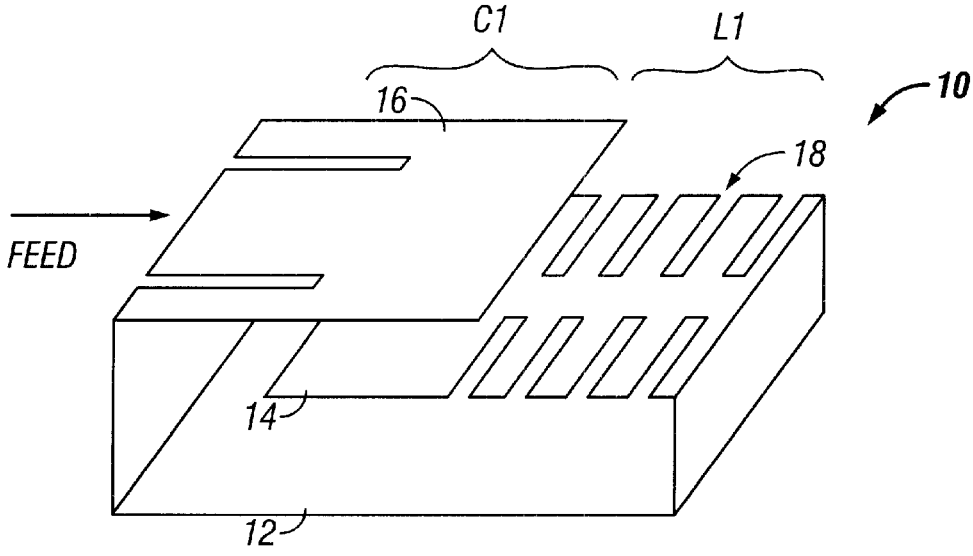
FIG. 1 illustrates the basic antenna structure of the present invention.

FIG. 1 illustrates an antenna structure in accordance with the present invention that is effective in improving the K factor at lower frequencies. Antenna structure 10 comprises a first conductor 12, which in many cases will be a ground plane, a second conductor 14 and a third conductor 16. The antenna may be viewed as is a coplanar waveguide characterized by a capacitive load C1 and an inductive load L1. The inductive load is established by a plurality of fingers 18, the magnitude of the load depending upon the widths, lengths and spacings between the individual fingers. The inductive load L1 allows the overall dimensions of antenna structure 10 to be reduced.

The inductive and capacitive loads of antenna structure 10 can be adjusted in accordance with the particular design constraints. In many cases, the overall size of the antenna will be dictated by the dimensions of the electronic device in which it must be installed. In these cases, the size of the capacitive portion becomes critical, which may require tight tolerances. This may lead to problems of manufacturability. To address these problems, it may be necessary to accept a capacitive portion that is manufacturable and then adjust the inductive portion to achieve the required inductive load within the available volume.

Figure 2:
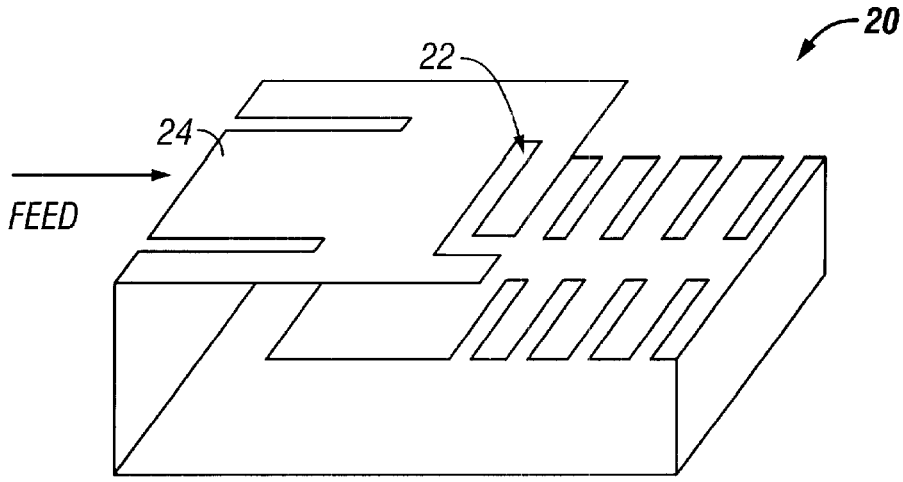
FIG. 2 illustrates a first modification of the basic antenna structure.

FIG. 2 illustrates an antenna structure 20 in which the capacitive portion is altered by the introduction of a slit 22 in conductor 24. The presence of the slit creates a second resonance since the effect of the slit on the capacitance is seen at one resonant frequency, but not at the other, thereby changing the value of the capacitance for the two resonant frequencies.

Figure 3:
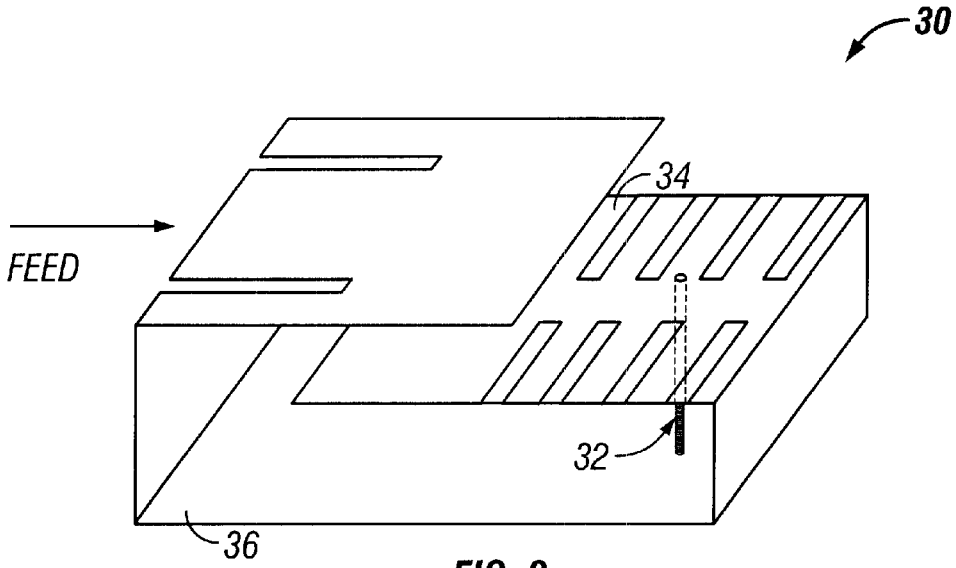
FIG. 3 illustrates a second modification of the base antenna structure.

Referring now to FIG. 3, another approach for creating multiple resonances is illustrated. Antenna structure 30 incorporates a short 32 between conductor 34 and the ground plane 36. In this configuration, there is a set of inductances (established by the dimensions of the fingers) that will be shorted at one frequency, but not at another. Antenna structure 30 can be viewed as having an equivalent circuit comprising a set of inductances with a capacitor in parallel.

Figure 4:
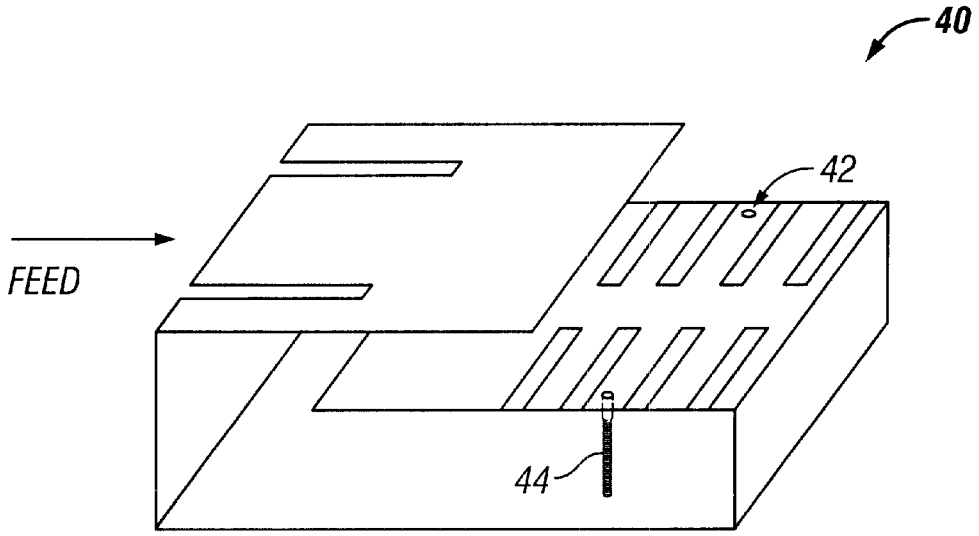
FIG. 4 illustrates a third modification of the base antenna structure.

FIG. 4 illustrates a similar antenna structure 40 with two shorts 42 and 44, one on each side of the antenna. Such an antenna structure will have a set of resonant frequencies. Optimization of the antenna design involves achieving multiple resonances through the width and depth of each finger and then determining the placement of the shorting pins.

Figure 5:
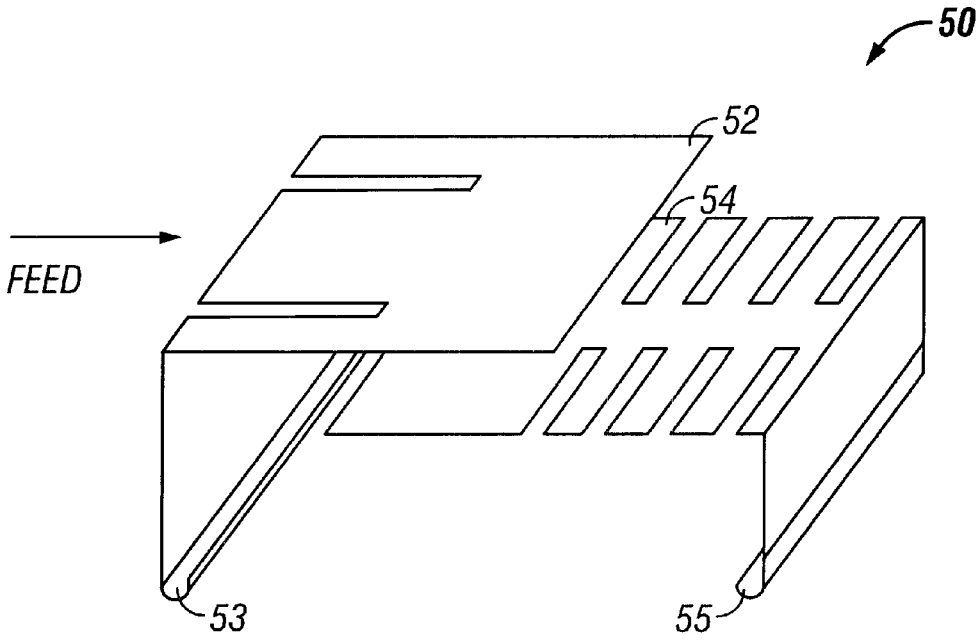
FIG. 5 illustrates an antenna structure according to the present invention designed for use with a separate ground plane.

FIG. 5 illustrates an antenna structure 50 as it may be configured for installation in a cellular telephone or other portable wireless device. Conductors 52 and 54 have respective spring contacts 53 and 55 to make electrical contact with a ground plane, which may be provided on a printed circuit board within the device. The antenna feed is shown connecting to the upper portion of conductor 52; however, it could be anywhere as long as there is a continuous conductive path coupling conductors 52 and 54. Since there is no rigid mechanical connection between conductors 52 and 54 in this design, a dielectric spacer may need to be inserted between the conductors in order to maintain the design separation between them, which is essential to maintaining the proper capacitance value. As is well understood, the dielectric characteristics of the spacer material will also be a factor in determining the capacitance value.

Figure 6:
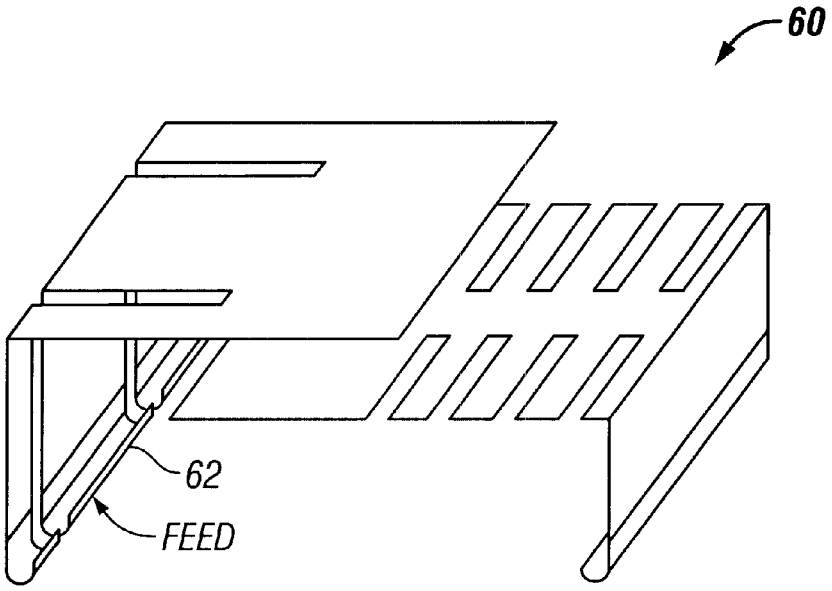
FIG. 6 illustrates a modification of the antenna structure of FIG. 5 with an alternative feed arrangement.

FIG. 6 illustrates another antenna structure 60 similar to that of FIG. 5. Here, however, the antenna feed comprises a spring contact 62 with a circuit board in the electronic device. This contact is established in the same way that the grounding contact with the conductors is established.

Figure 7:
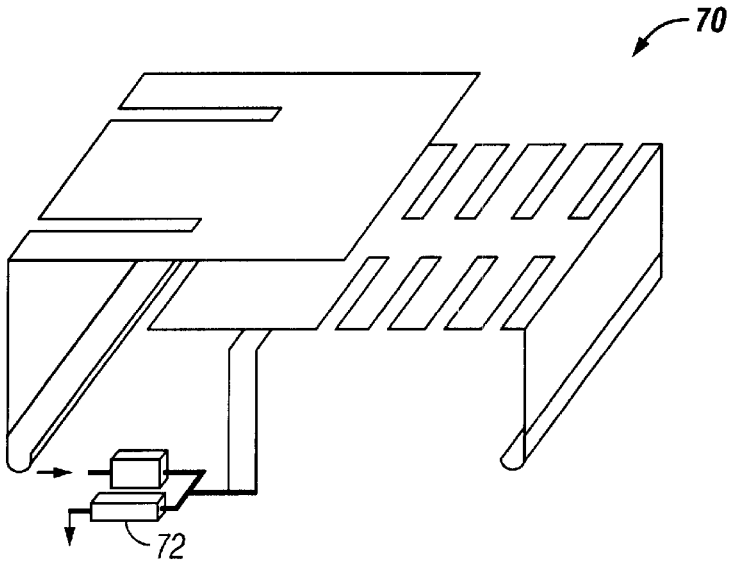
FIG. 7 illustrates the antenna structure of the present invention with a matching circuit of discrete components.

Referring now to FIG. 7, a matching circuit 72 external to antenna structure 70 may be employed, if necessary, to help cover the desired bandwidth in certain applications. The matching circuit may be implemented with conventional electronic components mounted on a circuit board in the electronic device.

Figure 8:
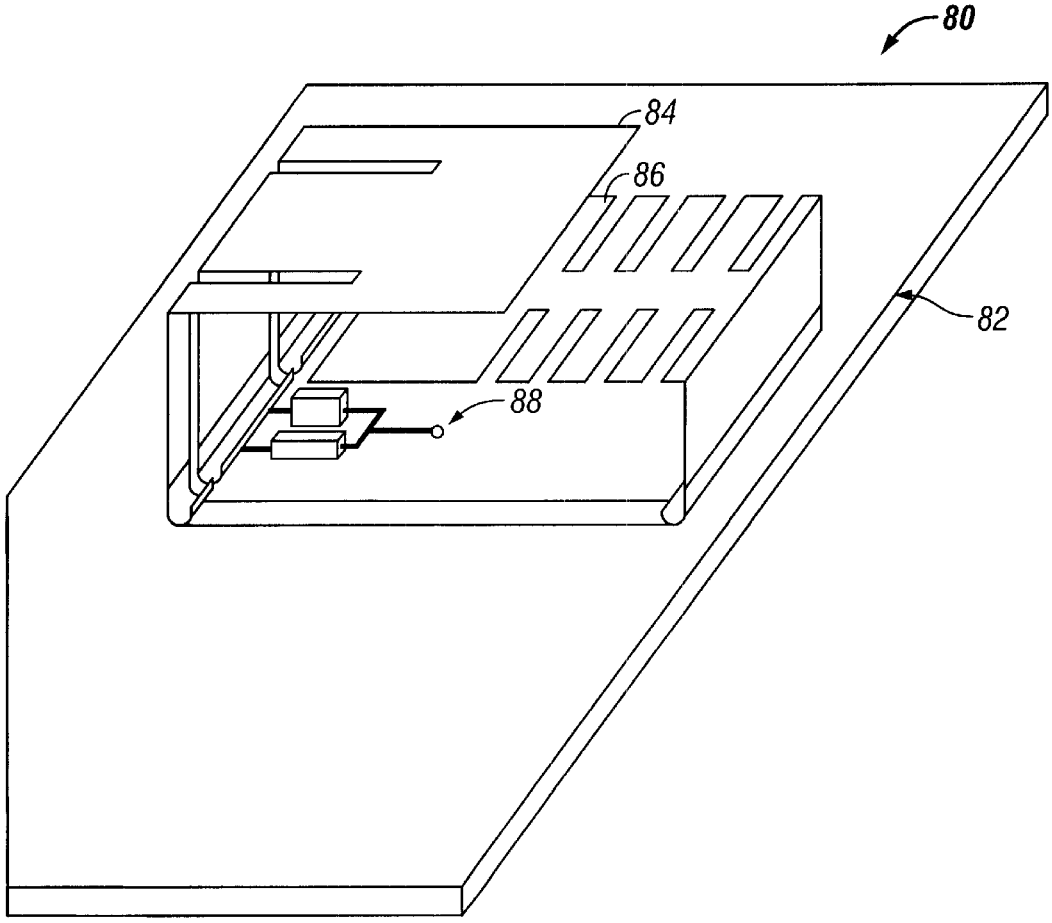
FIG. 8 illustrates the antenna structure of the present invention in an exemplary installation in a wireless communications device.

FIG. 8 illustrates the installation of antenna structure 80 on a circuit board 82 within an electronic device. Conductors 84 and 86 may be mechanically attached to a cover or other part of an enclosure for the electronic device. When the device is assembled, conductors 84 and 86 are brought into contact with circuit board 82. A matching circuit 88 is assembled on board 82 with conventional electronic components as previously described. The dimensions shown in FIG. 8 are for reference only, but illustrate the small size that may be achieved with the present invention.

Figure 9:
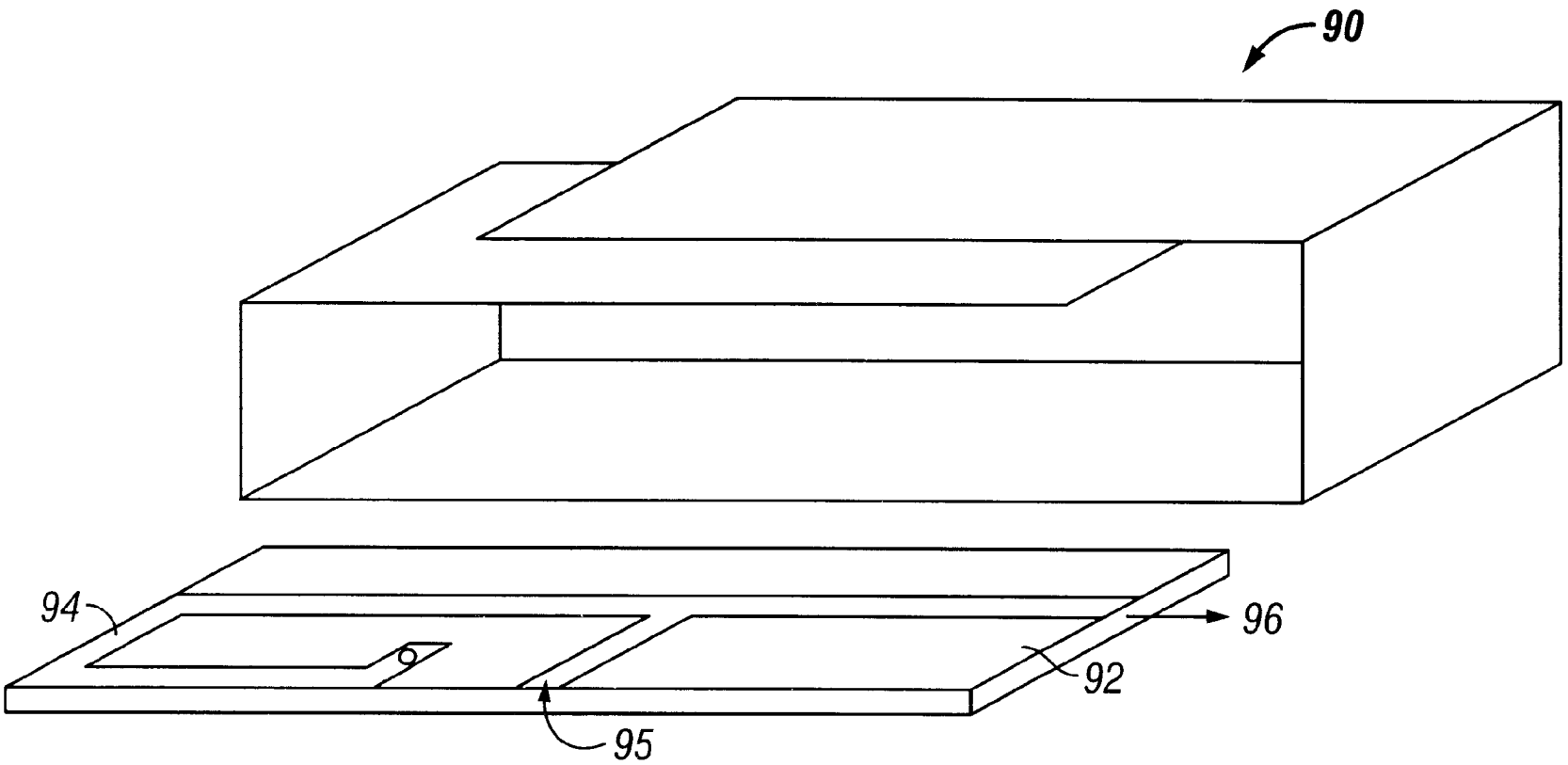
FIG. 9 illustrates an antenna with a separate, printed matching circuit.

FIG. 9 illustrates an alternative approach for implementing a matching circuit. Here, a set of conductive lines 94 are printed on or otherwise applied to a circuit board 92. This avoids the need to assemble a set of discrete components and therefore reduces the cost of the antenna. An input 95 is connected to a circuit trace on the circuit board. An output 96 is connected to the antenna. It should be understood that the pattern of the circuit traces shown in FIG. 9 is for illustrative purposes only and does not depict an actual matching circuit.

Figure 10:
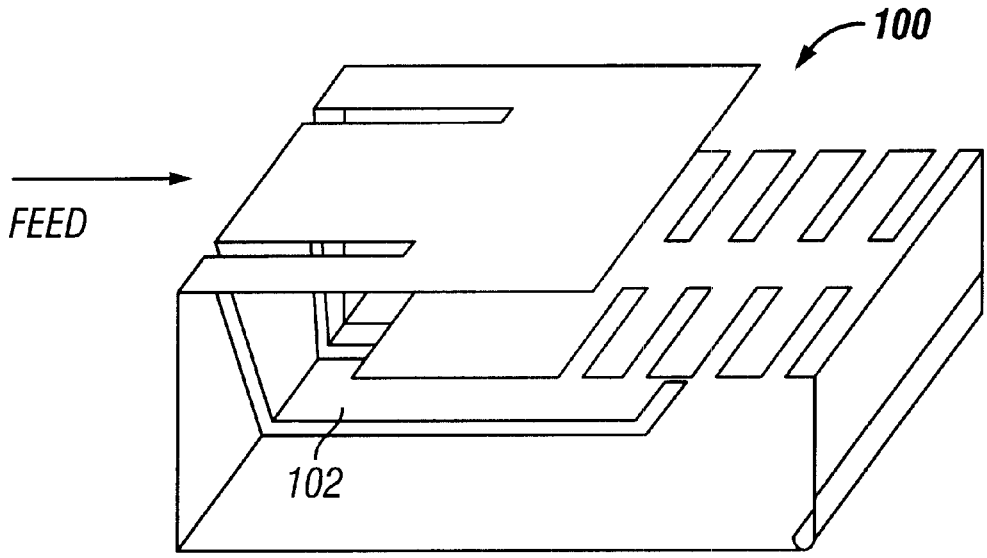
FIG. 10 illustrates an antenna structure modified to incorporate a portion of a matching circuit.

By extension of the concepts illustrated in FIG. 9, a portion of the matching circuit may be incorporated into the antenna structure itself as shown in FIG. 10. A tongue portion 102 of antenna structure 100 takes the place of a line printed on a separate substrate. This avoids at least some of the loss that would otherwise be experienced using the approach shown in FIG. 9.

Figure 11:
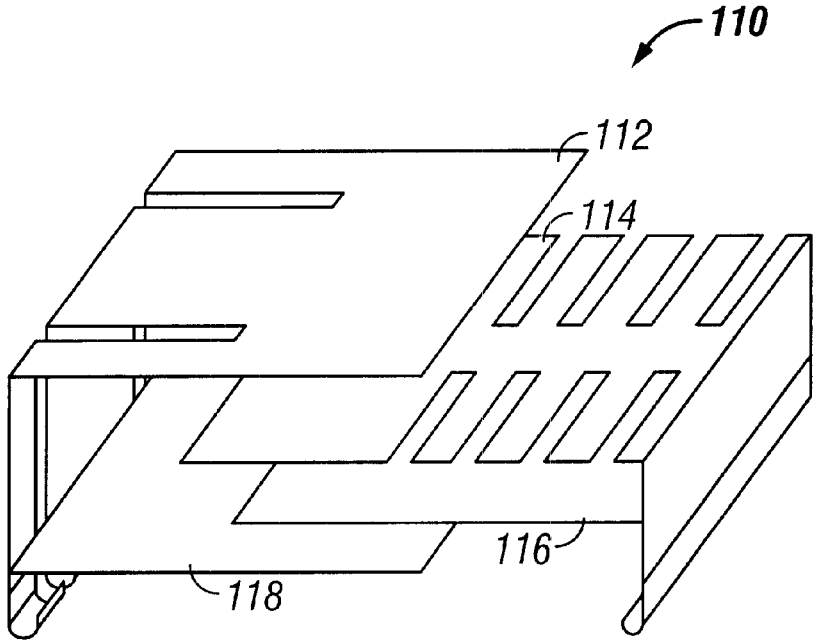
FIG. 11 illustrates a modification of the antenna structure to provide multi-frequency capability.

FIG. 11 shows an antenna structure 110 that is adapted for operation in multiple frequency bands that are relatively widely separated, such as, for example, in the case of GSM/PCS cellular telephones. Other wireless devices may be targeted for operation in both Bluetooth (2.4 GHz) and GPS (1.575 GHz) bands. Antenna structure 110 comprises conductors 112 and 114, which are similar to those of the previously described embodiments, particularly antenna structure 60 of FIG. 6, but includes additional conductors 116 and 118. These additional conductors form a secondary antenna structure within the first antenna structure to achieve the desired multi-frequency capability. Low frequency matching may still need to be accomplished using discrete components as previously described in connection with FIG. 7.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An antenna comprising:

a first conductor lying in a reference plane;

a second conductor extending longitudinally parallel to the reference plane having a first end electrically connected to the first conductor and a second end, the second conductor having a plurality of laterally extending fingers;

a third conductor extending longitudinally parallel to the reference plane having a first end electrically connected to the first conductor and a second end overlapping, but spaced apart from, the second end of the second conductor;

an antenna feed coupled to one of the second and third conductors.

2. The antenna of claim 1 wherein the third conductor includes a slot proximate to the second end.

3. The antenna of claim 2 wherein the slot extends laterally on the third conductor.

4. The antenna of claim 1 wherein the third conductor includes at least one slot proximate to the first end.

5. The antenna of claim 4 wherein said at least one slot extends longitudinally on the third conductor.

6. The antenna of claim 1 further comprising a short between the first conductor and the second conductor.

7. The antenna of claim 1 wherein the first conductor comprises a ground plane.

8. The antenna of claim 1 wherein the first end of the second conductor comprises a spring contact for establishing an electrical connection with the first conductor.

9. The antenna of claim 8 wherein the first end of the third conductor comprises a spring contact for establishing an electrical connection with the first conductor.

10. The antenna of claim 1 wherein the antenna feed comprises a portion of the first end of the second conductor spaced apart from a remainder of the first end of the second conductor.

11. The antenna of claim 10 wherein the antenna feed further comprises a spring contact on said portion of the first end of the second conductor.

12. The antenna of claim 1 further comprising a matching circuit.

13. The antenna of claim 12 wherein the matching circuit comprises a printed circuit co-planar with the reference plane.

14. The antenna of claim 12 wherein the matching circuit comprises a portion of the first conductor spaced apart from a remainder of the first conductor.

15. A wireless electronic device comprising:

a housing;

an RF circuit disposed in the housing;

an antenna disposed in the housing, the antenna having a first conductor lying in a reference plane;

a second conductor extending longitudinally parallel to the reference plane having a first end electrically connected to the first conductor and a second end, the second conductor having a plurality of laterally extending fingers;

a third conductor extending longitudinally parallel to the reference plane having a first end electrically connected to the first conductor and a second end overlapping, but spaced apart from, the second end of the second conductor, and an antenna feed coupled to the RF circuit and to one of the second and third conductors.

16. The wireless electronic device of claim 15 wherein the first conductor is disposed on a printed circuit board.

17. The wireless electronic device of claim 16 wherein the second and third conductors are attached to a portion of the housing spaced apart from the printed circuit board.

18. The wireless electronic device of claim 17 wherein the first end of the second conductor comprises a spring contact for establishing an electrical connection with the first conductor.

19. The wireless electronic device of claim 18 wherein the first end of the third conductor comprises a spring contact for establishing an electrical connection with the first conductor.

20. The wireless electronic device of claim 17 wherein the antenna feed comprises a portion of the first end of the second conductor spaced apart from a remainder of the first end of the second conductor.

21. The wireless electronic device of claim 20 wherein the antenna feed further comprises a spring contact on said portion of the first end of the second conductor.

* * * * *